United States Patent [19]

Olmsted

[11] 4,321,424

[45] Mar. 23, 1982

[54] HYDROCARBON ELECTRICAL INSULATION OIL CONTAINING TRI-CRESYL PHOSPHATE TO INCREASE WATER RETENTION CAPABILITY

[75] Inventor: John H. Olmsted, New Berlin, Wis.

[73] Assignee: RTE Corporation, Waukesha, Wis.

[21] Appl. No.: 892,315

[22] Filed: Mar. 31, 1978

[51] Int. Cl.[3] ..... H01B 3/22

[52] U.S. Cl. ..... 174/17 LF; 252/567; 252/574; 252/78.5

[58] Field of Search ..... 252/63.7, 63, 78.5, 252/49.8; 336/94; 174/17 LF

[56] References Cited

U.S. PATENT DOCUMENTS

| | | | |
|---|---|---|---|
| 1,721,295 | 7/1929 | Doerflinger | 252/63.7 |
| 2,133,311 | 10/1938 | Shuman | 252/63.7 X |
| 2,175,877 | 10/1939 | Clark | 252/63.7 X |
| 2,224,695 | 12/1940 | Prutton | 252/49.8 X |
| 2,722,561 | 11/1955 | McCulloch | 252/63.7 X |
| 2,730,499 | 1/1956 | Pokorny | 252/49.8 |
| 3,135,627 | 6/1964 | Sadler | 252/63.7 X |
| 3,931,022 | 1/1976 | Chesluk et al. | 252/78.5 X |
| 4,082,866 | 4/1978 | Link | 174/17 R X |

*Primary Examiner*—Harris A. Pitlick
*Attorney, Agent, or Firm*—Ronald E. Barry

[57] ABSTRACT

An oil capable of use in environments where the accumulation of water is detrimental to the intended use, the oil consisting of branched and straight chain aliphatic hydrocarbons and minor amounts of tri-cresyl phosphate.

4 Claims, No Drawings

HYDROCARBON ELECTRICAL INSULATION OIL CONTAINING TRI-CRESYL PHOSPHATE TO INCREASE WATER RETENTION CAPABILITY

BACKGROUND OF THE INVENTION

In co-pending application Ser. No. 616,673 entitled Method of Use and Electrical Equipment Utilizing Insulating Oil Consisting of a Saturated Hydrocarbon Oil, filed on Sept. 25, 1975, now U.S. Pat. No. 4,082,866 certain highly refined petroleum oils or mineral oils were disclosed which were considered sufficiently nonflammable to serve as insulating oil substitutes for polychlorinated biphenals in electrical equipment which is operated at moderate ambient temperatures of 0° C. to about 40° C. These oils comprised straight and branched chain aliphatic paraffinic hydrocarbons which have a molecular weight of about 500 to about 700, preferably about 600, and a fire point above 200° C. In this regard, a suitable aliphatic paraffinic oil disclosed was a dual treat base oil which is a solvent treated deeply hydrogenated bright stock and is predominantly a paraffinic oil with a molecular weight in excess of 600.

It has been found that where the insulating fluid is of a hydrocarbon origin and where paper or other cellulosic material is used to provide physical separation of the conductive elements, decomposition of the paper or cellulosic material produces water. Additional water is introduced by the exchange of air over the oil in the normal thermal cycling of the equipment, if vented. Solubility of water in the dielectric insulating fluid is therefore of utmost importance.

Thermal aging of the insulation system, whether by normal or abnormal means, produces a quantity of water which must be absorbed and maintained in the insulating fluid. If the quantity of water is sufficient to saturate the insulating fluid, the excess water produced will form a second phase with a high dielectric constant and a low dielectric strength. This is a demonstrated sequence in the path leading to the early failure of these systems.

It has been found that in using a aliphatic paraffinic hydrocarbon as the insulating fluid as described above, the solubility of water is much less than that experienced with conventional transformer oil.

In testing some of the Askarel substitutes to increase their fire point for this use, a chemical known as tri-cresyl phosphate, manufactured by the Stauffer Chemical Co. and sold under the trade name "SYN-O-AD8484", was tested to increase fire point. This additive was found to have limited solubility in the above described paraffinic hydrocarbon oil (approximately 2.5% by volume at normal room temperature). At that concentration, this material offered no advantage with respect to improving the flammability properties of the blend. However, it was restrained in its negative effects upon the electrical properties of the fluid blend. This material is described by Stauffer Chemical Co. as hydrolizing slowly under wet, alkaline conditions at ambient temperatures and has shown a surprising stability under accelerated aging conditions.

When the question of water solubility of the aliphatic paraffinic hydrocarbon oils was raised, this was one of the materials which was looked at as providing a solution to that problem. This, in spite of tri-cresyl phosphate being a phosphate ester and thus labeled as being unstable in the presence of water. It is virtually universally accepted by the experts in hydrocarbon dielectric fluids that phosphate esters as a class hydrolize in the presence of water to form phosphoric acid. Very low concentrations of phosphoric acid in a dielectric insulating fluid would result in a decrease in its electrical resistivity by several orders of magnitude. This would inevitably lead to early failure of the equipment.

SUMMARY OF THE INVENTION

This invention relates to hydrocarbon oils, specifically aliphatic hydrocarbon oil, having an improved water retention capability by the addition of minor amount of a phosphate ester. This oil is intended for use in high temperature transformers wherein dielectric insulating materials, either paper or other cellulosic material, is used to provide physical separation of the conducting elements of the transformer. The barrier material decomposing under operating conditions to produce water in the dielectric fluid. This oil is also capable of use in environments where water is detrimental to the intended use, i.e. hydraulic systems.

DESCRIPTION OF THE INVENTION

Obviously, if the concentration of water in the oil is greater than the solubility limit, there will be significant quantities of free water present in the oil. This water will tend to separate out and collect at the lowest point in the container. However, in the process of getting to that location and undergoing the various changes of temperature, this water will have a finite probability of passing through highly electrically stressed regions. Further, when the concentration of water is less than the solubility limit for the system as a whole, there will be locations where the temperature and pressure are such that the solubility limit will be exceeded. It should be noted that the solubility limit is affected by the electrical stress.

The aliphatic paraffinic hydrocarbon oil according to the present invention is intended for use in environments where the introduction of water into the oil would be detrimental. In electrical apparatus wherein conducting elements are separated by paper or cellulosic barrier materials, water is produced by the decomposition of these materials under operating conditions. This water must be absorbed in the fluid.

The hydrocarbon oil is a straight and branched chain aliphatic paraffinic hydrocarbon. When used as an insulating oil it has a molecular weight of about 500 to about 700 and preferably about 600.

It has been found that water solubility characteristic of the above described saturated hydrocarbon paraffinic oil is improved by the addition of a small quantity of a relatively matching molecular weight ester to the oil. The recommended concentration is from 0.2 to 0.8 percent by weight of a compatible phosphate ester, such as tri-cresyl phosphate. In the preferred embodiment of this invention, 0.5 percent by weight of meta and para isomers of tri-cresyl phosphate is added to the aliphatic paraffinic hydrocarbon oil.

The phosphate ester which has been used successfully with the aliphatic hydrocarbon oil is tri-cresyl phosphate sold under the trade name SYN-O-AD8484 by Stauffer Chemical Company. This material has the following properties:

| Physical State | Liquid |
|---|---|
| Specific Gravity, 20 °/20° C. | 1.167 |
| Density, pounds/gallon | 9.7 |
| Boiling Point, 10 mmHg, °C. | 260–275 |
| Pour Point, °C. | −25 |
| Viscosity, 100° F., SUS | 125 |
| Flash Point, °F., COC | 465 |
| Fire Point, °F., COC | 685 |
| Autoignition Temperature, °F. | 1100 |

The embodiments of the invention in which an exclusive property or privilege is claimed are defined as follows:

1. In an electrical apparatus comprised of an oil tank, an electrical component in the tank having cellulosic material separating the electrical elements and a saturated hydrocarbon oil which oil is liquid throughout the temperature range of 0° C. to 40° C., the improvement comprising:

an additive consisting of tri-cresyl phosphate ester in an amount by weight of the insulating oil of 0.2 to 0.8 percent which minimizes the detrimental effects that can result from the decomposition of the cellulosic materials under operating conditions.

2. The electrical apparatus of claim 1 in which the insulating oil consists essentially of straight and branched chain aliphatic hydrocarbons.

3. In an electrical apparatus comprised of an oil tank, an electrical component in the tank having cellulosic material separating the electrical elements and a saturated hydrocarbon oil having an average molecular weight of about 500 to about 700 and a fire point above 200° C. which oil is liquid throughout the temperature range of 0° C. to 40° C., the improvement comprising:

an additive consisting of tri-cresyl phosphate ester in an amount of 0.2 to 0.8 percent by weight of the insulating oil which minimizes the detrimental effects that can result from the decomposition of the cellulosic materials under operating conditions.

4. The electrical apparatus of claim 3 in which the insulating oil consists essentially of straight and branched chain aliphatic hydrocarbons.

* * * * *